US005924247A

United States Patent [19]

Van Horn et al.

[11] Patent Number: 5,924,247

[45] Date of Patent: Jul. 20, 1999

[54] LIGHTWEIGHT STRUCTURAL PANEL CONFIGURED TO RECEIVE POURED CONCRETE AND USED IN WALL CONSTRUCTION

[75] Inventors: Kenneth C. Van Horn; Cornelius P. Van Horn, both of Orlando, Fla.

[73] Assignee: Lott's Concrete Products, Inc., Winter Garden, Fla.

[21] Appl. No.: 08/808,110

[22] Filed: Feb. 28, 1997

Related U.S. Application Data

[60] Provisional application No. 60/018,544, May 29, 1996.

[51] Int. Cl.[6] ..... E04B 2/24; E04C 1/00

[52] U.S. Cl. ..... 52/100; 52/309.16; 52/309.17; 52/379; 52/421; 52/439; 52/505

[58] Field of Search ..... 52/100, 98, 309.7, 52/309.16, 309.17, 379, 421, 439, 503, 505, 565

[56] References Cited

U.S. PATENT DOCUMENTS

| | | |
|---|---|---|
| 3,552,076 | 1/1971 | Gregori . |
| 3,788,020 | 1/1974 | Gregori . |
| 3,872,636 | 3/1975 | Nicosia . |
| 3,922,828 | 12/1975 | Patton . |
| 4,223,501 | 9/1980 | DeLozier . |
| 4,532,745 | 8/1985 | Kinard . |
| 4,604,843 | 8/1986 | Ott et al. . |
| 4,879,855 | 11/1989 | Berrenberg . |
| 4,889,310 | 12/1989 | Boeshart . |
| 5,247,773 | 9/1993 | Weir . |
| 5,329,741 | 7/1994 | Nicolaidis et al. . |
| 5,404,685 | 4/1995 | Collins . |
| 5,440,846 | 8/1995 | Record . |

FOREIGN PATENT DOCUMENTS

| | | |
|---|---|---|
| 2267430 | 11/1975 | France . |
| 2460 374 | 1/1981 | France . |
| 295 11 542 U1 | 11/1995 | Germany . |
| 1169723 | 11/1969 | United Kingdom . |

*Primary Examiner*—Robert Canfield

*Attorney, Agent, or Firm*—Allen, Dyer, Doppelt, Milbrath & Gilchrist, P.A.

[57] ABSTRACT

A component of lightweight structural material to be utilized in the construction of a sturdy wall, the component being elongate and generally in the configuration of a rectangular solid whose height is approximately three to four times its width. The component involves a pair of elongate sidewalls, a pair of end portions, a bottom section, and an upper section. An elongate, trough-like recess is located along the upper section between the elongate sidewalls, and a plurality of elongate, generally vertically disposed apertures are disposed in an essentially parallel relationship below the trough-like recess. The upper end of each of the elongate apertures is directly below the trough-like recess, with the trough-like recess being adapted to receive and contain molten concrete, with some of such concrete being able to flow into and fill the vertically disposed apertures. It is to be noted that the upper end of each of the elongate apertures is initially blocked from contact with the trough-like recess by a relatively minor thickness of lightweight structural material, with such material blocking the contact between the elongate apertures and the trough-like recess being readily removed by a user so that selected ones of the vertically disposed apertures can be filled with concrete.

15 Claims, 6 Drawing Sheets

FIG. 1a.
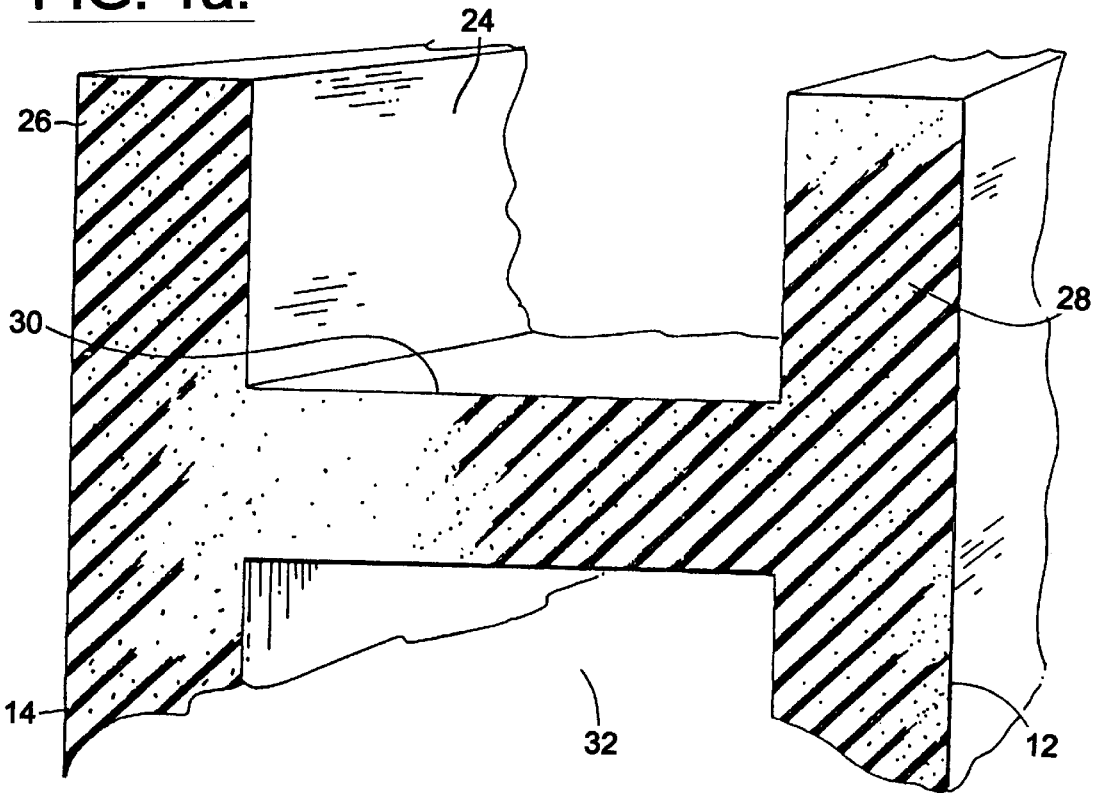
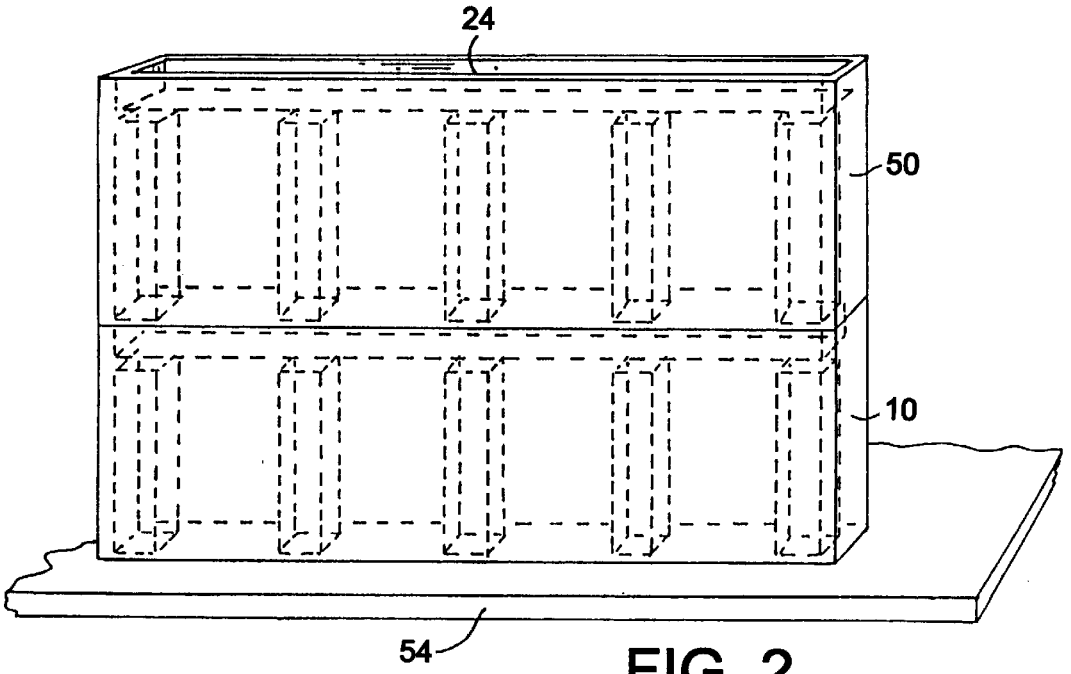
FIG. 2.

LIGHTWEIGHT STRUCTURAL PANEL CONFIGURED TO RECEIVE POURED CONCRETE AND USED IN WALL CONSTRUCTION

PROVISIONAL APPLICATION

This invention relates to the subject matter of Provisional Application No. 60/018,544 filed May 29, 1996.

BACKGROUND OF THE INVENTION

For several generations now it has been known to utilize concrete blocks of a standard size in the construction of homes, apartment houses, office buildings and many other structures. Although block size can vary in accordance with the particular utilization to be made, one standard size of concrete block measures 8"×8"×16", and has two rather large cavities separated by the center web of the block.

For reasons of strength, it is well known to place the concrete blocks in a "staggered" relationship when constructing a wall, with one layer or tier of blocks offset approximately 8" from the tier directly below it. The configuration of these standard size concrete blocks is such that the cavities of the numerous blocks utilized in the construction of a wall are to a substantial extent caused to line up vertically.

Many building codes pertaining to both residential and commercial buildings require a special construction technique to be utilized at the location where one wall portion intersects another wall portion, such as in a 90° relationship. As one example, reinforcement bars ("rebars") are frequently inserted down along the block cavities defined at the corners where one wall intersects the other. In addition to this, concrete is usually poured down through the intersecting cavities of the blocks located at such corner.

Another important constructional technique required by most building codes is the pouring of a lintel along the top of the substantially completed block wall. In this instance, "channel" type concrete blocks are utilized as the top member of each wall portion, with rebars placed horizontally in the aligned channels extending along each wall portion. Bent rebars are utilized at each corner. As a result of this construction, concrete can be poured into the channel-type concrete blocks utilized along the top of each wall, with the bent rebars utilized at each corner preventing the corners from separating. This type of construction is much stronger than would have been the case if the concrete blocks had not been topped off with poured concrete, and the intersecting corners had not been suitably reinforced.

Various efforts have been made in the past to avoid the cost and labor expense involved in the creation of walls constructed of concrete blocks, and one of these prior art techniques is set forth in the Gregori U.S. Pat. No. 3,552,076 entitled "Concrete Form." The Gregori patent teaches the utilization of a self-supporting concrete form of foamed polymeric material molded in one piece and involving two spaced longitudinal walls. One or more partitions may be utilized along the length of Gregori's concrete form in order to form vertically disposed apertures for receiving molten concrete. Although this patentee teaches the utilization of means providing reinforcement for the concrete poured into these vertically disposed apertures, it is to be seen that Gregori's molds are not much taller than the height of conventional concrete blocks, which of course means that considerable speed in the creation of a wall utilizing Gregori's technique would not be readily possible. In addition, Gregori's patent exhibits no comprehension of the use of a trough-like recess extending along the upper section of his molds for receiving molten (wet) concrete, nor any recognition of a technique wherein the builder is able to economize in the use of concrete by selecting only certain vertically disposed apertures of his molds to receive the molten concrete.

A generally similar teaching is involved in Gregori's U.S. Pat. No. 3,788,020 entitled "Foamed Plastic Concrete Form with Fire Resistant Tension Member," but this teaching involves the utilization of metal members bridging between the elongate side members of this particular concrete form, thus increasing labor costs as well as material costs insofar as the creation of these concrete forms is concerned.

The Nicosia U.S. Pat. No. 3,872,636 entitled "Light Weight Load Bearing Metal Structural Panel" and the DeLozier U.S. Pat. No. 4,223,501 entitled "Concrete Form" each necessitate the use of concrete forms of lightweight material needing metal members for strengthening purposes. The Nicosia patent involves the use of sections of expanded metal, whereas the DeLozier patent involves transverse connecting members serving to support and position the sidewall members as well as to define mold cavities, but these techniques necessarily increase the cost of material and labor.

The Ott et al U.S. Pat. No. 4,604,843 entitled "Lost-Form Concrete Falsework" teaches the use of insulating slabs of foam material that are held in an upright orientation in a spaced apart relationship so that concrete can be poured therebetween. In a similar manner to certain of the other prior art techniques, these patentees teach the use of elements of a ladder-like configuration that are utilized for holding the slabs of foam material in the properly spaced relationship. Obviously a wall of this construction is quite heavy, and like the other patents of this type, the amount of concrete utilized in the construction of the wall cannot be varied in accordance with the needed strength of the wall.

The Berrenberg U.S. Pat. No. 4,879,855 entitled "Attachment and Reinforcement Member for Molded Construction Forms" pertains to an arrangement in which the left and right halves of a form for receiving wet concrete are held together by expanded metal mesh. This arrangement is expensive and the patentee says nothing regarding an option on the part of the builder for utilizing a substantial amount of concrete in the event a wall of great strength is needed, or a less amount of concrete in the event strength demands are not high and it is desirable to save on the expense of concrete.

A somewhat similar technique is set forth in the Boeshart U.S. Pat. No. 4,889,310 entitled "Concrete Forming System" in which opposed polystyrene panels are stacked to form a pair of parallel, spaced apart walls held apart by special tie members, with concrete to be poured between the members. Like Ott et al, the Boeshart technique brings about the creation of a very heavy wall, rather than a lightweight loadbearing wall in which the amount of concrete utilized in the wall can be selectively modified.

Weir U.S. Pat. No. 5,247,773 entitled "Building Structures" teaches the use of extruded plastic utilized in the creation of building components, with these plastic members being equipped with elongated male and female means whereby such components can be secured together to create walls and the like. While this technique may be usable for internal walls, this technique does not enable walls of considerable weight bearing capability to be created.

Nicolaidis et al U.S. Pat. No. 5,329,741 entitled "Portable Constructional Element and a Process for its Production" teaches the creation of a portable constructional element made up of a foamed cementitious material provided with an outer plastic covering. While this technique may be usable in wall construction of a certain type, this procedure would not be suitable for utilization in the creation of exterior loadbearing walls.

Collins U.S. Pat. No. 5,404,685 entitled "Polystyrene Foamed Plastic Wall Apparatus and Method of Construction" teaches the use of foamed plastic panels able to be inserted in the grooves of columns, but as is obvious, these panels have very little strength and would not be suitable for bearing any considerable mount of weight.

The Record U.S. Pat. No. 5,440,846 entitled "Construction for Building Panels and Other Building Components" teaches a composite building component of a cement composition utilizing an amount of diatomaceous earth or other thermally insulating material in a specified ratio to entrained air, thus to provide a degree of thermal insulation. This technique, however, bears little relationship to the rapid construction of loadbearing walls wherein the amount of concrete utilized in the wall can be varied in accordance with the need for strength.

It was in an effort to overcome the shortcomings of these patents and the need for rapid loadbearing wall construction that the present invention was evolved.

SUMMARY OF THE INVENTION

It has been found, in accordance with this invention, that by utilizing large STYROFOAM panels of substantially rectangular configuration, typically either four feet long or eight feet long, loadbearing walls can be made straighter and faster than is possible using individual blocks. As will shortly be described, these panels or components are of consistent size and consistent configuration, each being equipped with a plurality of parallel, generally vertically disposed apertures into which concrete can be poured in the interest of creating a wall having great compressive strength. The panels or components in accordance with this invention may for example be of STYROFOAM that is 7½" to 9½" in width and 32" high, or in other words, the height of the panels can be on the order of three to four times their width.

Although we prefer the use of STYROFOAM polystyrene plastic and frequently refer to construction using STYROFOAM, it is to be understood that we are not to be limited to STYROFOAM or "EPS" (expanded poly STYROFOAM) block technology. For example, various lightweight structural materials of the types mentioned in the patents cited hereinabove may be used. Among the various structural materials usable in selected circumstances are high density foamed synthetic resins such as expanded polystyrene, extruded polystyrene foam, polyurethane foam, or a foamed phenolformadehyde or like resin.

It is obvious that a panel of lightweight structural material used alone would have only a tiny fraction of the compressive strength of a concrete block wall, but as will be explained at length hereinafter, the top edge of each large STYROFOAM panel provided in accordance with the preferred embodiment of this invention is channeled so as to receive rebars, with concrete to thereafter be poured into the channel and into other parts of the panel in order to provide considerable strength to the panel.

Most importantly, the large STYROFOAM panels or components created in accordance with this invention have the aforementioned elongate, generally vertically disposed apertures occurring at regular, preestablished intervals, with these apertures being provided in a closely disposed relationship to the channeled top edge of the STYROFOAM panel. Rebars can be placed in these elongate, generally vertically disposed apertures. Therefore, at such time as all of the desired rebars are in place, concrete is poured into the trough-like channel extending along the top edge of the STYROFOAM panel, with some of the concrete also pouring down the vertically disposed apertures. In this way, "columns" of concrete are defined at spaced intervals along the wall created by the use of these STYROFOAM panels. By the liberal use of the rebars in the vertical apertures and along the generally horizontally disposed trough-like channel extending along the top of each STYROFOAM panel, the resulting wall is even stronger than it would have been the case had concrete blocks been used.

It is most important to note with the preferred embodiment of this invention that we provide at the time of manufacture, a comparatively thin separation between the underside of the channeled top edge of the panel, and the top of each of the elongate, generally vertically disposed apertures. In a manner of speaking, these separation portions amount to "plugs" or blockage material of STYROFOAM at the top of each vertically disposed aperture of the STYROFOAM panel, thus to prevent, in the first instance, the filling of such apertures with concrete. As is obvious, many of these separation portions or plugs must be removed to permit the flow of concrete down selected vertically disposed apertures, thus to permit the creation of the vitally needed columnar portions of the wall being created. However, it is to be realized that some walls require great compressive strength whereas other walls do not. It is quite apparent that all of the plugs or blockage components would be removed in instances when extreme compressive strength is required, but if great wall strength is not required in a particular instance, not all of such STYROFOAM separation portions or plugs would he removed. As a result of the non-removal of these separation portions or plugs, concrete can he saved and the wall created more inexpensively than would have been the case if every vertically disposed aperture of the panel was to be filled with concrete.

Other than having a thickness generally consistent with a concrete block wall, our novel STYROFOAM panels or components do not need to be of any fixed size, although for reasons of manufacture, and with regard to the transport of the panels to the job site, the panels are preferably four feet in length. In some instances, however, we may construct somewhat longer panels, such as six to eight feet in length. It is to be noted that when a particular length and configuration of panel has been selected, all of the panels manufactured to that criteria are consistent, including the height of the panels and the spacing and placement of the generally vertically disposed, concrete-receiving apertures.

With regard to the strength of the wall in the locations between the above-described "columns" of concrete, after the wall has been completed, stucco can be applied to the outside of the several panels, in the interests of providing further strength to the wall, and wallboard can be applied to the inside portions of the wall. Other options include gypsum board, tiles, plywood and the like firmly secured to the longitudinal sides of the panels.

By way of example of the way we go about creating sufficient columnar strength in the walls we construct, there may be five parallel, vertically disposed cavities approximately 5½"×5½" in cross section in each basic panel. Because we often wish to pour concrete on 24" centers, we preferably manufacture basic panels four feet long, with a middle vertical aperture placed at a location equidistant from the ends. On each side of this middle aperture is a vertically disposed aperture, with the center of each of these latter two apertures being 12" away from the center of the middle aperture, thus placing this pair of apertures on 24 inch centers. Outboard of each of the apertures residing on each side of the middle aperture may be an additional aperture, the center of each of which may be 4¾" from the respective end of the basic component.

These five cavities extend from the bottom of the panel up for approximately 24½", thereby leaving from one to four inches of material separating the top of each of the generally vertically disposed cavities from the lower portion of the horizontal cavity or trough-like recess into which the wet concrete is initially poured.

It should be clear that a builder utilizing these novel panels will have the choice or option, at the time concrete is being poured, of removing the inch or more of STYROFOAM material blocking the top of selected vertical cavities, such as by the use of a pocket knife, hot wire or the like, thereby enabling the horizontally disposed and the vertically disposed cavities to be joined together in an exceedingly strong manner by the poured concrete.

As is obvious, quite a number of substantially identical STYROFOAM components are required in the building of a loadbearing wall, such as the wall of a home, apartment house, office building or the like. Some of these components are to be secured together in a stacked relationship, with other components brought into an end-to-end relationship, by the use of concrete reinforced by rebars, in a manner described at length hereinafter.

It is now to be seen that in accordance with this invention, we have provided basic components of lightweight structural material and consistent size to be utilized in the construction of a sturdy, loadbearing wall. These basic components are elongate and generally in the configuration of a rectangular solid, involving a pair of side portions, a pair of end portions, a bottom section, and an upper section. In the preferred embodiment of this invention, a trough-like recess of essentially uniform depth is located along the upper portion, with such trough-like recess being an ideal receptacle into which molten concrete is to be poured after a sufficient number of rebars have been installed.

A plurality of elongate, generally vertically disposed apertures are disposed in an essentially parallel relationship below this trough-like recess, with these apertures being in an essentially perpendicular relationship to the trough-like recess. The trough-like recess is continuous, meaning that the upper end of each of these apertures is separated from the interior of the trough-like recess by a consistent, relatively minor thickness of the lightweight structural material of which each panel is constructed. The trough-like recess is clearly adapted to receive and contain molten concrete, with some of such concrete being able to flow downwardly into and fill only those elongate, generally vertically disposed apertures above which the relatively minor thickness of material has been removed by the user.

It is thus an object of this invention to provide a lightweight panel having a height approximately three to four times its width, which is usable as a mold for the production of a hand poured, steel reinforced, loadbearing wall that is able to be constructed much more rapidly and more economically than can a wall of similar strength be created by the use of preformed blocks.

It is another object of this invention to provide a novel lightweight panel such as of foamed polymeric material, created to a consistent size and utilized as a mold for wall production, into which mold, molten concrete may be poured so as to create a steel reinforced, loadbearing wall, which wall may form an intrinsic portion of a house, commercial building or the like.

It is yet another object of this invention to provide a novel lightweight panel usable as a mold for the production of a loadbearing wall, which enables the builder to vary the amount of concrete utilized in the construction of the wall in accordance with the need for strength, thins to make it readily possible to economize on the amount of concrete used when great wall strength is not needed.

It is yet another object of this invention to provide a novel lightweight panel usable as a mold for the production of a loadbearing wall, which panel is of consistent size and sufficiently sturdy construction as not to require the insertion of strengthening internal members of metal while the panels are being formed.

It is still another object of this invention to provide a series of substantially identical lightweight panels, each equipped with elongate, generally vertically disposed apertures into which concrete may be poured, with the consistency of the placement of the apertures in such panels enabling two or more panels to be placed in a stacked relationship such that a series of aligned vertically disposed apertures are defined, into which molten concrete may be poured, thereby to create a series of vertically disposed, elongate concrete columns of considerable strength.

It is yet still another object of this invention to provide a series of substantially identical lightweight yet sturdy panels, each provided with a plurality of elongate, generally vertically disposed concrete-receiving apertures, with the upper end of each of the vertically disposed apertures being provided with easily removed closure or blockage means, so that only selected ones of such vertically disposed apertures can be filled with concrete in an instance in which great compressive strength is not required, and economic factors are of considerable importance.

It is yet still another object of our invention to provide a novel method utilized in the rapid construction of a loadbearing wall in which novel components of lightweight structural material each contain a plurality of elongate, generally vertically disposed apertures residing in a consistently spaced, essentially parallel relationship between the sidewalls of the component, with a continuous trough-like recess being ultilized above these apertures in the preferred instance, from which these apertures are separated by blockage material, with this blockage material being selectively removable by a user from locations above certain selected ones of the generally vertically disposed apertures, with molten concrete to be poured into the trough-like recess and to thereafter flow into and fill only the selected elongate apertures.

It is yet still another object of this invention to provide a novel method to be utilized in the creation of a wall utilizing a plurality of elongate components of lightweight structural material in the configuration of a rectangular solid, with each of the components principally involving a pair of elongate sidewalls extending the length of the component, and a plurality of elongate, generally vertically disposed apertures residing in an essentially parallel relationship between the elongate sidewalls, with this method involving the steps of placing a second elongate component of lightweight structural material equipped with a horizontally extending trough-like recess atop a first elongate component of lightweight structural material such that the generally vertically disposed apertures of the two components are in substantial alignment, and then pouring molten concrete into the trough-like recess of the second elongate component, this enabling some of such concrete to flow into and fill the elongate apertures of the two components.

The apertures of the second elongate component are normally separated from the trough-like recess by blockage material, with this novel method involving the additional step of removing the blockage material from certain of the generally vertically disposed apertures, so that some of such concrete can flow into and fill the selected elongate apertures of the two components.

These and other objects, features and advantages of this invention will be set forth at greater length hereinafter.

BRIEF DESCRIPTION OF THE DRAWINGS

FIG. 1*a* is a fragmentary view to a large scale, illustrating the fact that one to four inches of the foamed polymeric material of which the panel is preferably constituted exists between the trough-like recess and a vertically disposed aperture, with these one to four inches of lightweight structural material being easily removed in the event a builder wishes this particular vertically disposed aperture to receive concrete;

FIG. 2 is a view showing how a wall two tiers in height can be constructed from the joinder of a pair of the preferred form of basic panels illustrated in FIG. 1;

DETAILED DESCRIPTION

Figure 1:
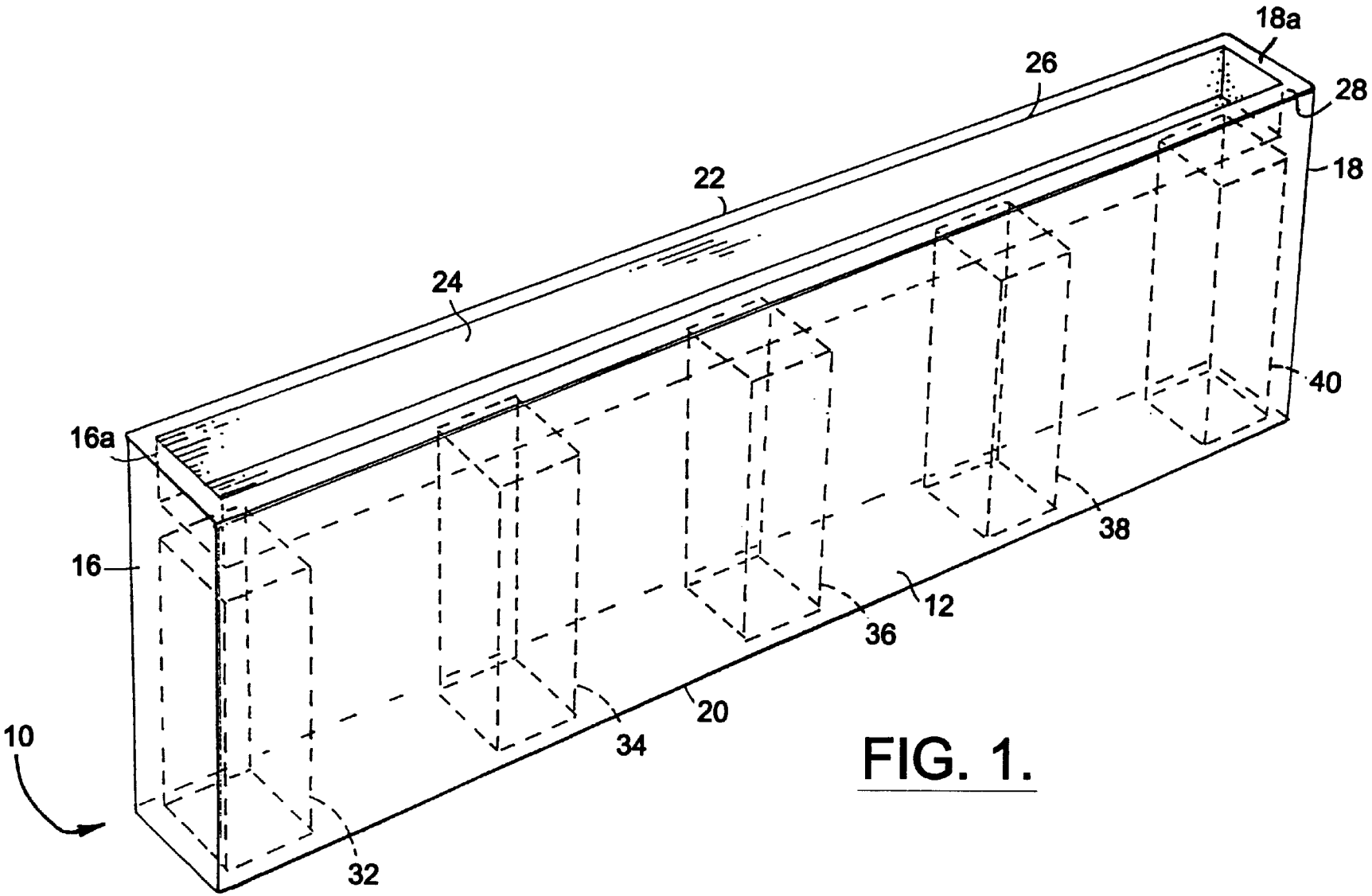
FIG. 1 is a perspective view of a preferred version of a basic lightweight panel in accordance with this invention, with the trough-like recess that extends continuously along the top of panel being shown in full lines, but with the vertically disposed, essentially parallel apertures being shown in dashed lines inasmuch as these are not visible from the exterior of the panel.

With initial reference to FIG. 1 it will be seen that we have shown a typical component 10 of lightweight construction to be utilized, in accordance with this invention, in the construction of a sturdy, loadbearing wall. As will be noted from this figure, the component 10 is an elongate panel generally in the configuration of a rectangular solid, having a pair of side portions, with only side portion 12 being visible in FIG. 1. We prefer the use of STYROFOAM in the construction of the component 10, but we are obviously not to be limited to this material. As previously mentioned, various lightweight structural materials of the types set forth in the patents cited hereinabove may be used. Among the various structural materials usable in selected circumstances are high density foamed synthetic resins and the like.

Each basic or standardized component 10 also has end portions 16 and 18, a bottom section 20, and an upper section 22. The basic component 10 may for example be 4 feet long and 32 inches in height, although in some instances we may utilize basic sections that are 8 feet long. Despite its lightweight construction, the component 10 becomes an intrinsic part of a loadbearing wall. The basic component 10 is typically between 7½ inches and 9½ inches in width, meaning of course that it is approximately three to four times as high as it is wide. Obviously we are not to be limited to any of these dimensions.

With continued reference to FIG. 1, it is to be understood that our novel component or panel utilizes elongate sidewalls involving upper side portions and lower side portions. It is important to note that in accordance with a preferred embodiment of our novel component or panel, we utilize an elongate trough-like recess 24 being defined between the upper side portions. The trough-like recess 24 extends in a continuous manner generally horizontally along the upper portion 22, and it is into this recess that concrete is to be poured.

With reference to FIG. 1*a*, the trough-like recess 24 may be seen as being principally defined between sidewalls 26 and 28, which represent the upper side portions or upward extensions of the side portions 12 and 14. The continuous trough-like recess 24 may for example be 5½" wide, with the sidewalls 26 and 28 each being approximately 2" thick for components 9½" wide, or 1" thick for components 7½" wide. End members 16*a* and 18*a*, representing upward extensions of the end portions 16 and 18, prevent the overflow of concrete from the ends of the trough-like recess 24.

With respect to FIG. 1*a* it will be noted that the bottom or floor of the trough-like recess 24 is represented by a lower portion 30. The lower portion 30 may, for example, involve one to four inches of STYROFOAM or other suitable lightweight structural material, directly below which are a series of elongate, generally vertically disposed apertures residing in a perpendicular relationship to the trough-like recess 24. These one to four inches of lightweight structural material serve as readily removable "plugs" or separation means that in the initial instance represent a blockage serving to prevent the downward flow of concrete from the elongate recess 24 into the generally vertically disposed apertures.

Returning to the preferred embodiment of our invention depicted in FIG. 1, it will be seen that we have shown in ample detail, the elongate, generally vertically disposed apertures 32, 34, 36, 38 and 40, which extend from the location just below the lower portion 30 of the trough-like recess, down to the bottom section 20 of the component 10. These generally vertical apertures reside in an essentially parallel relationship below the trough-like recess 24, being separated from the trough-like recess by the above-mentioned relatively minor thickness of the bottom or floor portion 30. This floor portion is typically constituted by the same lightweight structural material of which the component 10 is constructed, and is easily removed, when desired, from the locations directly above the generally vertically disposed apertures. Either a pocket knife or a hot wire is usually sufficient for removal of the STYROFOAM at the selected locations above the elongate, generally vertically disposed apertures.

It is to be understood that the trough-like recess 24 is continuous at the time the panel or component is manufactured, with this recess being adapted to receive and contain wet (molten) concrete. As a result of the builder removing selected portions of the material constituting the bottom portion of the recess 24, some of such concrete being able to flow into and fill certain ones of the generally vertically disposed apertures mentioned hereinabove. In other words, the builder has the option of removing the "plug" or bottom portion 30 representing the blockage located directly above only those of the elongate generally vertically disposed apertures that are desired to be used in the creation of strong elongate columns of concrete. The resulting columns of concrete are typically four or so times as high as they are wide.

With regard to wall strength if, for example, a wall being constructed needs to be particularly strong, the material constituting the "plug" or bottom portion 30 will be removed from the location directly above each of the generally vertically disposed apertures, whereas if a wall of lesser strength is to be constructed, concrete can be conserved by not removing the bottom portion of the trough member 24 above every vertically disposed aperture, but only certain ones. One particularly viable option in the utilization of our invention involves the pouring of concrete on 24" centers, as will be described hereinafter.

It is obvious that in some instances, our novel component 10 can be utilized for constructing a wall closely resembling the configuration of the device depicted in FIG. 1, which of course could be made considerably longer by being joined in an end-to-end relationship with other substantially identical sections. When a low height wall is being constructed, the provision of the trough-like recess 24 is particularly important, which recess would he filled with concrete and then carefully leveled so as to form a desirable, durable upper surface for the wall. Depending on the use to which the wall is to be put, reinforcement bars (rebars) may be inserted in the vertically disposed apertures and also laid in the trough-like recess 24 before the concrete is poured. It is typical when the lightweight structural panels are being laid end-to-end, to break out the ends of the trough-like members so that rebars (and concrete) can extend continuously from one lightweight panel to the next.

A more typical utilization of our invention, however, is represented in FIG. 2, wherein the construction involves a second component or panel 50 of lightweight construction stacked atop the first component or panel 10, with their vertical apertures in alignment. The components are substantially identical, and for convenience, we will refer to the stacked construction depicted in FIG. 2 as involving a first course or layer and a second course or layer.

We have found that it is unnecessary for the concrete associated with the first course to be completely set (dry) before the component or components associated with the second course are utilized. This is to say, after the trough-like recess extending along the upper part of the first or lower course is partially set, generally vertically disposed rebars may be inserted therein. Quite understandably, the rebars will be disposed at a spacing coinciding with the generally vertically disposed apertures of the component or components 50 constituting the second course of components. In this way, a loadbearing wall will be created whose first and second courses are integrated together in a sturdy, highly effective manner. As is obvious, the components of lightweight structural material for each successive course or layer of the wall are arrayed such that their generally vertically disposed apertures will be in alignment with the generally vertically disposed apertures of the first course or layer. In this way the completed wall will have columnar strength extending in an essentially continuous fashion all the way from the lowermost portion or section of the wall to the uppermost portion or section of the wall.

It is to be understood that in accordance with our invention, the builder can economize on the amount of concrete used in the event the wall being constructed does not need to have great strength, in which case only certain ones of the generally vertically disposed apertures located between the elongate sidewalls are to be filled with concrete. Further economy can of course be accomplished by employing components or panels utilizing the trough-like recess only at the top of the wall, with components or panels omitting the trough-like recesses being utilized during the construction of the lower portions of the wall.

Figure 3:
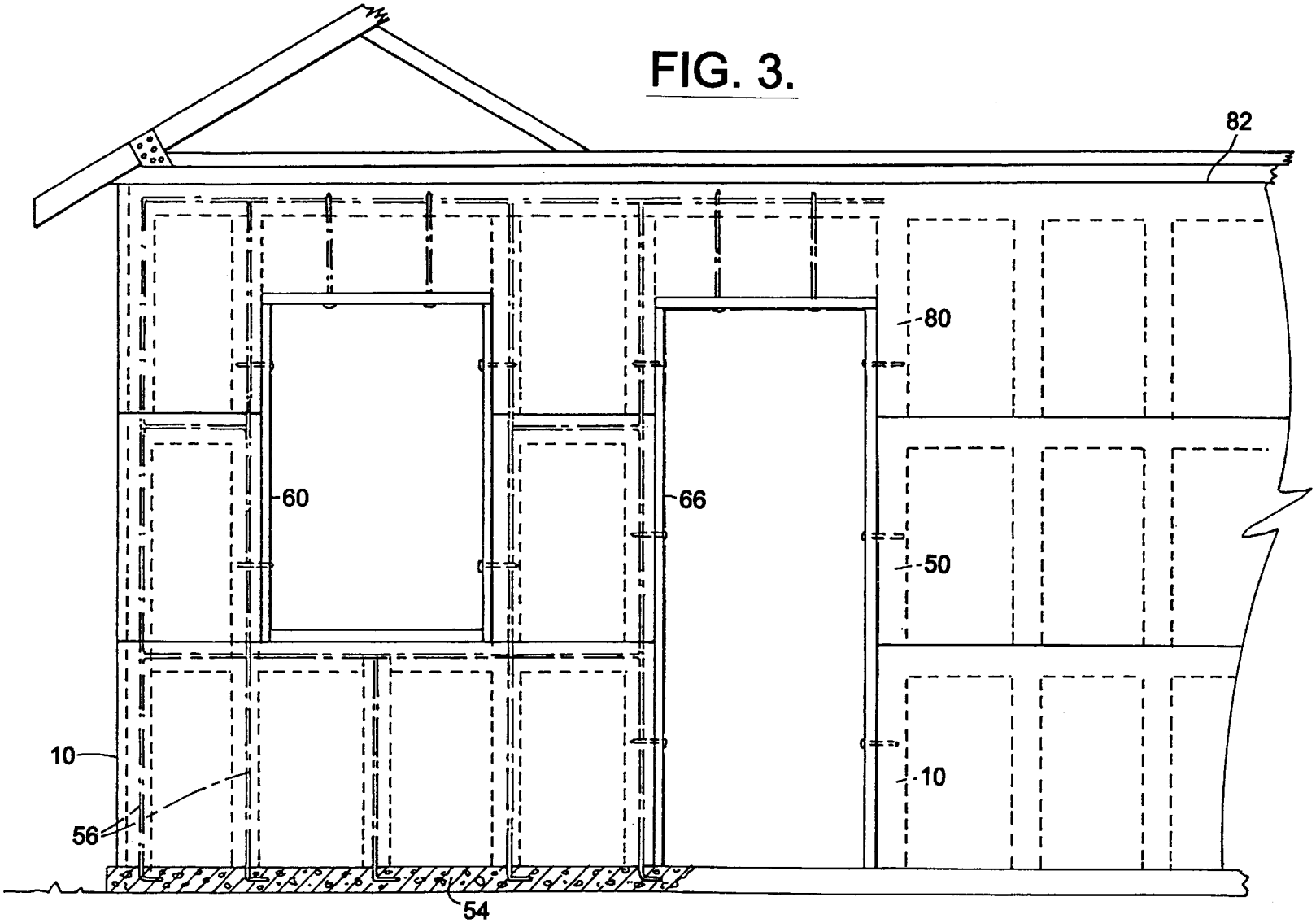
FIG. 3 is a view of the wall of a typical house constructed utilizing the techniques taught in accordance with this invention, with it being readily apparent from this figure that three tiers or sections of lightweight panels can be utilized together in the construction of a wall of suitable height.

Turning now to FIG. 3, we have shown how a number of components of lightweight structural material can be utilized in assembled relation in order to create a loadbearing wall utilized for example in the construction of a house. Assuming that the wall is to be something on the order of 96 inches in height, and presuming the utilization of panels approximately 32" in height, then three of our novel panels are used in a stacked relationship in the creation of the wall. In other words, a second, and then a third basic component of lightweight structural material intended to constitute the second and third layers or courses of the wall are placed upon each of the lowermost components, that is, the components in direct contact with a concrete slab 54. In order that the completed wall will possess suitable strength, it is obvious that a suitable amount of concrete must be poured into the lightweight components of each course or level, as will hereinafter be discussed.

It is apparent from FIG. 3 that we are depicting a wall of a house, but as is obvious, the construction involving our novel components of lightweight structural material may be effectively utilized in the construction of loadbearing walls for a wide variety of other buildings as well, including small office buildings, motels, condominiums, and the like.

In FIG. 3, the construction typically starts with the concrete slab 54 being poured to a suitable thickness, with the lower ends of vertically disposed rebars 56 of appropriate size being inserted into the concrete of the slab before it sets. For a reason soon to be apparent, these vertically disposed rebars are utilized in a particular spacing. Then, after the slab 54 has reached a desired degree of firmness, one or more elongate basic components 10 of lightweight structural material in accordance with this invention is placed over the upstanding rebars, such that at least one rebar extending upwardly from the slab resides in each of the generally vertically disposed apertures of the component 10 constituting the lowest course or level of the wall. Before any concrete is poured into the trough-like recess 24 extending along the top of this lowermost component 10, however, one or more rebars of appropriate size are typically laid in such trough-like recess. These additional, generally horizontally disposed rebars residing in the trough like recess 24 may or may not be directly tied in with the rebars 56 extending upwardly from the slab 54 at essentially right angles to the recess 24, through the generally vertically disposed apertures of the lowermost component 10.

As previously mentioned, the builder has the option of cutting into the bottom of the trough-like recess 24 so as to open the upper end of selected ones of the generally vertically disposed apertures of each component or panel. Quite understandably, when the blockage is removed and the concrete has been poured into the trough-like recess extending along the top of each component, the concrete will pour into and fill only the selected vertically disposed apertures. Where the lower portion 30 remains intact in the form of a "plug" or blockage above a given vertically disposed aperture, no concrete flows into that vertically disposed recess. As is obvious, the more of the apertures that are opened, the greater will be the strength of the wall. However, in some instances where great wall strength is not involved, it may be desirable, from the standpoint of economy and the conservation of concrete, to open only selected ones of the generally vertically disposed apertures. Common sense dictates that concrete will not likely be poured into a generally vertically disposed aperture of the second or third course or level unless concrete had previously been poured into the corresponding generally vertically disposed recess located directly therebelow.

As indicated hereinabove, where economy is a primary factor, and great wall strength is not needed, it is possible, in mid portions of a wall, to utilize panels or components that do not contain the continuous trough-like recess, hilt this is not a preferred form of our invention.

It will be seen from the left side of FIG. 3 that a window is to be inserted at a location directly above the lightweight component in direct contact with the concrete slab 54. In order that the window can be incorporated into the construction, it is obvious that a desired spacing must be observed in the placement of the next layer or course of lightweight components in order that the frame 60 of the window may be accommodated.

It is typical that rebars extend for the full height of the wall of the house or other building, so before the concrete associated with the first layer or course of the house wall has set, the lightweight components associated with the second layer or course of the wall are placed in properly aligned relationship upon the components constituting the first course, with rebars then being inserted down through the generally vertically disposed apertures of the second course and into the concrete of the trough-like recess of the first course.

It is typical that the lightweight components to be utilized in the construction of each course or layer of a given wall will be carefully in place before the concrete for that course or layer is poured, so in the case of FIG. 3, the lightweight components directly contacting the slab 54 will be in place and filled with concrete to the fullest extent desired before the components constituting the second course or layer have been added. Because a door is to be incorporated into the wall depicted in FIG. 3, it is obvious that in placing the first lightweight component on the right-hand side of the slab 54, allowance will be made for the insertion of a frame 66 to be utilized for receiving a door.

In a manner resembling that described with regard to FIG. 2, when constructing the wall depicted in FIG. 3, it is obvious that after the concrete of the first course has substantially set, the components 50 constituting the second course are then placed in carefully aligned relation upon the components 10 of the first course, with the generally vertically disposed apertures of the courses being in alignment. After the rebars have been inserted into the apertures of the second course, concrete is then poured into the trough-like recess of each of the second course components, with concrete flowing down into the generally vertically disposed apertures whose upper portions have been uncovered. It has already been made clear that the bottom portion 30 below a typical trough-like recess 24 is removed from the location directly above any vertically oriented aperture that is intended to receive concrete, but the bottom portion of the recess 24 is of course permitted to remain intact above locations where concrete is not to enter the vertically disposed apertures.

As is obvious, we prefer to insert a suitable number of rebars into each of the generally vertically disposed apertures of the second course or level of the wall. Likewise, rebars are laid in a generally horizontal manner in the trough-like recess of each of the lightweight components constituting the second course or level of the loadbearing wall. As previously mentioned, we typically break out the ends of the trough-like recesses so that rebars (and concrete) can extend continuously between one lightweight structural panel and the next lightweight structural panel with which it is in an end-to-end relationship.

After the second course or level of the loadbearing wall has been substantially completed by the pouring of concrete, the lightweight basic components constituting the third course are then to be added, with the vertically disposed apertures of each of the components being in substantial alignment with the apertures of the components therebelow.

It has previously been mentioned that it is not necessary for the concrete of a lower course to have completely set before the concrete associated with the next course is poured. This is particularly true in an instance in which it is desired for the rebars of one course to be carefully integrated into the concrete of the component immediately below.

At this point it is to be recalled that in describing the wall of single height depicted in FIG. 1, it was mentioned that the trough-like recess is completely filled and leveled, but it is also to be noted that it is not always necessary to fill the trough-like recess of the lowermost component and the middle component of a wall utilizing lightweight components utilized on three separate levels. In other words, in economizing on the use of concrete, it may be desirable to insert an elongate, generally horizontally disposed "filler" member such as of STYROFOAM into the trough-like recess of a lower panel of the wall, to lessen somewhat, the demand for concrete for the trough-like recess. This of course is an alternative to the aforementioned economy version of our invention in which the trough-like recess has been eliminated from the components or panels utilized in an intermediate level of a wall. The type of construction utilizing either a horizontally-disposed "filler" member, or in the utilization of panels or components from which the trough-like recess has been eliminated are manifestly to be used only when great wall strength is not a requisite.

Returning to the construction depicted in FIG. 3, it is understood that the lightweight components 80 constituting the uppermost course or level of the wall will have their respective trough-like recesses completely filled with concrete after, of course, the desired number of rebars have been inserted.

The filling of the trough-like recess of the uppermost components is of particular importance inasmuch as it is desired for the concrete poured into the uppermost trough-like recesses to be leveled so as to form a proper support for roof members known as plates. As will be familiar to those concerned with the construction of houses and other buildings, large threaded bolts are often placed in a vertical relationship in the concrete constituting the uppermost edge of a block wall or the like. Holes are drilled into corresponding positions in the wooden plates 82, typically treated 2"×10" lumber, so that the plates can be firmly bolted to the top of the wall.

Upon the plates being bolted to the wall, they are ready to receive the members constituting the roof trusses, which of course can be 2"×6" or 2"×8" timbers in most instances. The underside of the roof trusses are frequently notched at the location where they are directly supported by the plates extending around the top of the wall, thus to create particularly sturdy construction.

Returning to the arrangement depicted in FIG. 3, it will be noted that we may secure the window frame 60 and the door frame 66 in their respective apertures by the use of long nails driven into the window and door frames before the concrete is poured. Then, when the concrete has set around the long nails, the window and door frames will be held tightly in place.

No particular structural components are required above the window frame 60 and the door frame 66, although we may utilize rod hangers embedded in the top beam.

It is obvious that in the construction of a house, apartment, office building or the like, there will be instances in which loadbearing walls are to be interconnected, so special consideration must be given to the manner in which components of lightweight structural material in accordance with this invention are joined together laterally as well as vertically in order that sturdy, durable intersections will be created.

Figure 4:
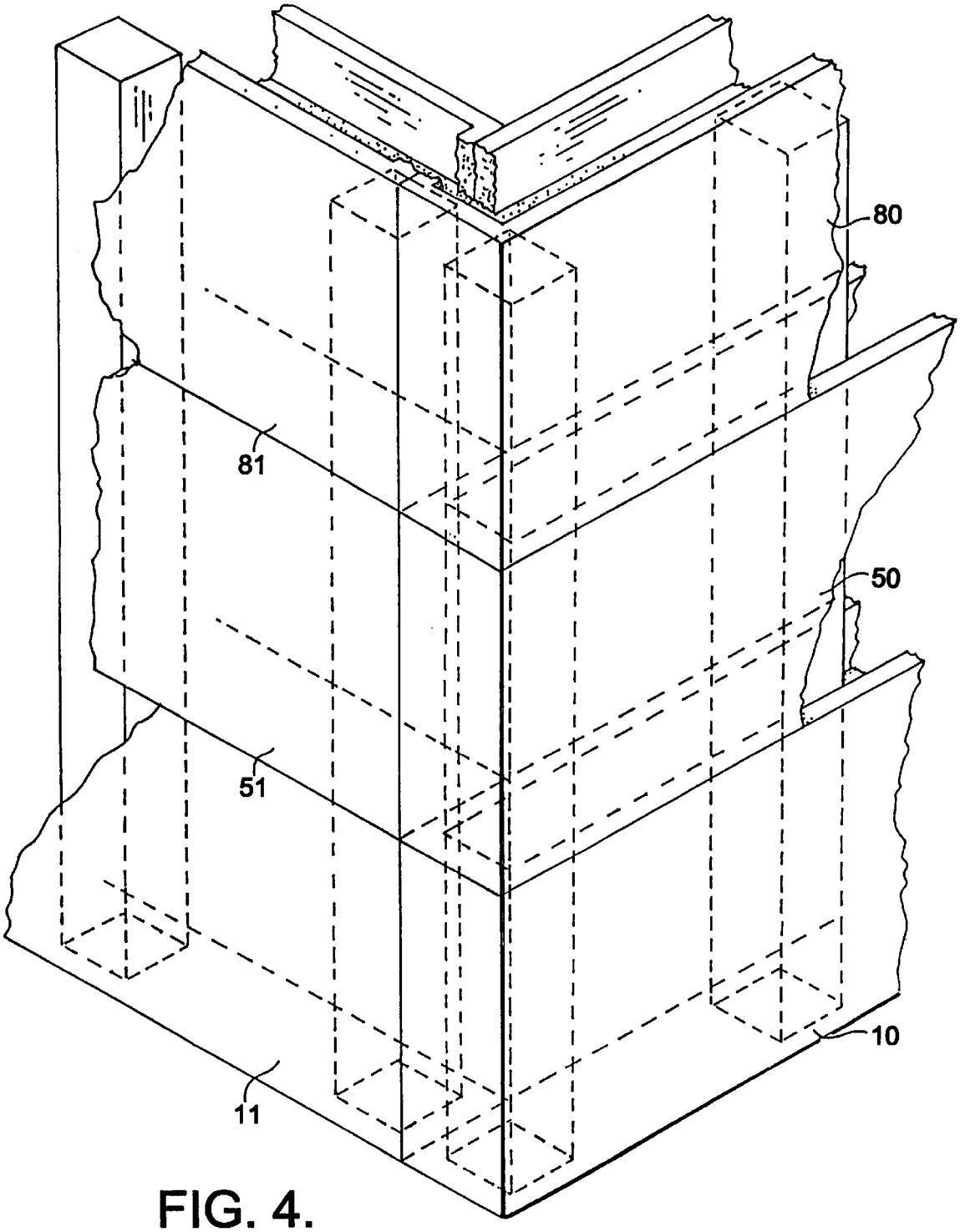
FIG. 4 is a view to a large scale of preferred corner detail, illustrating how the intersecting blocks are locked together in a strong, weight bearing fashion.

With reference to FIG. 4, it will be noted that we have shown lightweight basic components 10, 50 and 80 of one wall in an intersecting relationship to lightweight components 11, 51 and 81, respectively, of a wall disposed at a 90° angle to the wall constituted by components 10, 50 and 80. It obviously would be highly undesirable for the components 10, 50 and 80 to merely reside alongside the components 11, 51 and 81 and not be connected thereto. For this reason, we prefer an arrangement of the type shown in FIG. 5, wherein lowermost component 10 is shown in close contact with the lowermost component 11 of the intersecting wall. It will be noted from FIG. 5 that a part of the side portion of the component 10 has deliberately been removed. In addition, the end portion of the component 11 is broken away, so as a result of this construction, concrete can be poured into this intersection location so as to tightly secure the components 10 and 11 together.

Figure 5:
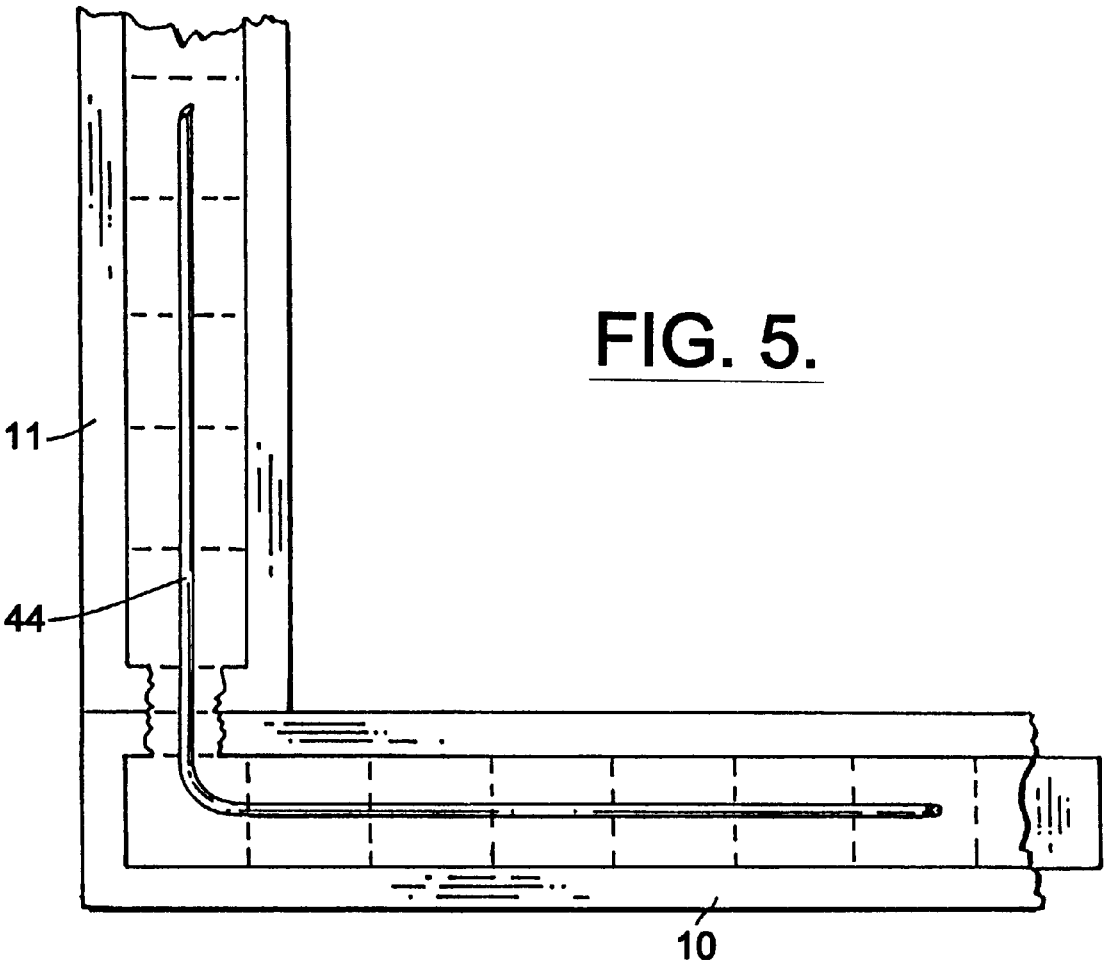
FIG. 5 is a view from above of a typical corner illustrating how foamed polymeric material is selectively removed from a side edge of one panel and from the end of the adjacent panel, so that one or a plurality of bent rebars can be utilized in the corner, with it to be understood that poured concrete can extend between the intersecting panel members in order to create a particularly strong joint.

As is obvious, rebars such as rebar 44 bent approximately into L-shaped configuration are utilized at each corner location, to assure considerable strength. Understandably, the type of construction depicted in FIG. 5 is also utilized at the intersection location of components 50 and 51 as well as at the intersection location of components or panels 80 and 81 in FIG. 4.

Figures 6, 7:
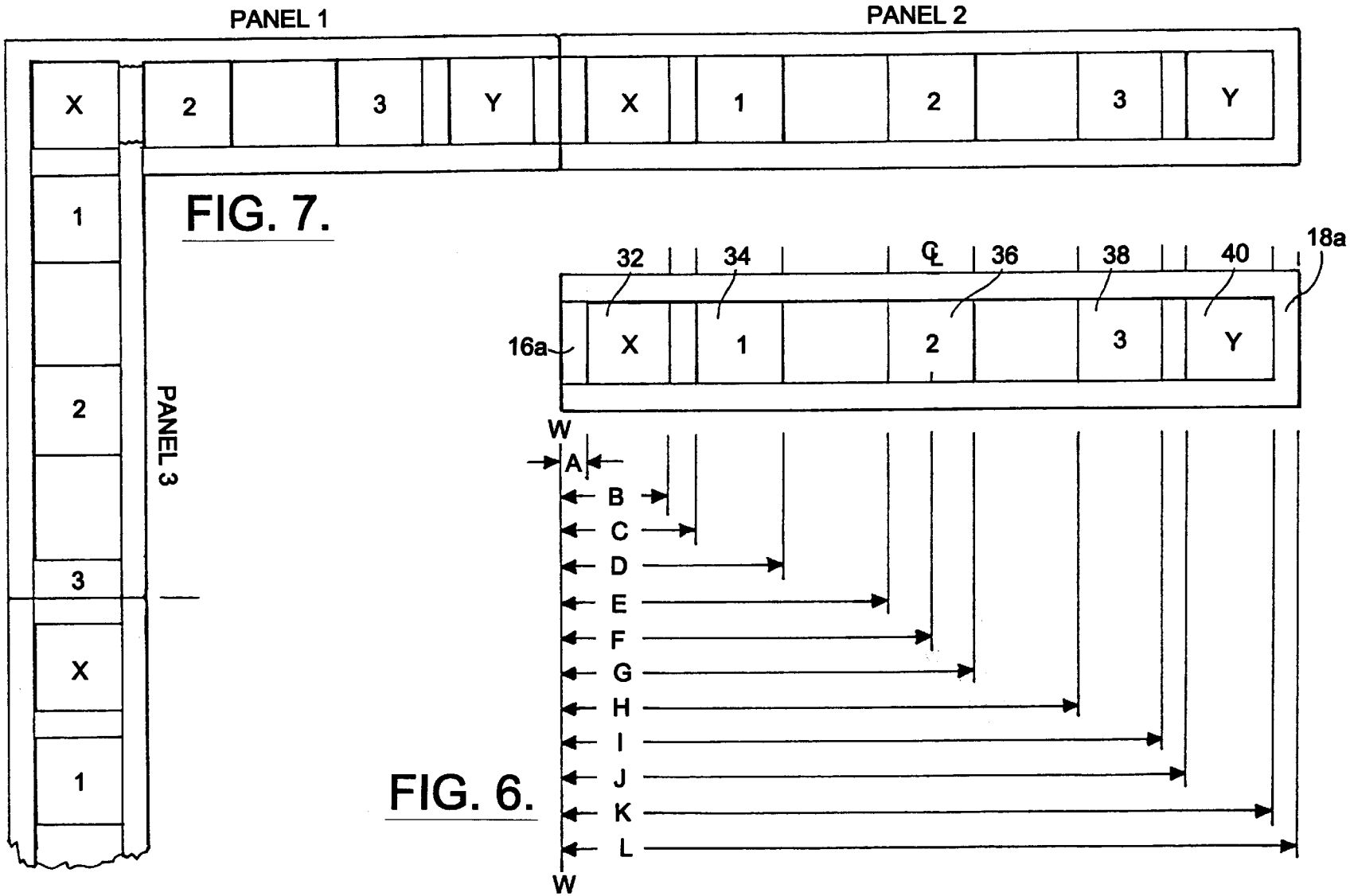
FIG. 6 is a view of the upper surface of a typical panel from which the trough-like portion has been removed, in order to make visible the location of the vertically disposed apertures.
FIG. 7 is a view similar to FIG. 6 but showing how multiple panels can be joined together in an end-to-end relationship, with this view further illustrating the manner in which the vertical apertures are filled with concrete in an instance in which it is desired to pour concrete on 24" centers.

With regard to FIG. 6, it will be noted that we have shown the upper surface of a typical basic panel in accordance with our invention, looking downward into the generally vertically disposed apertures 32 through 40. In the interests of revealing the placement of the generally vertically disposed apertures most clearly, we have entirely removed the trough-like recess 24 from this figure of drawing, as well as from adjacent FIG. 7.

With particular reference to FIG. 6, it will be noted that we have depicted a typical component or panel in accordance with our invention which, as mentioned previously, may be 48" in length and 32" in height. FIG. 6 will be seen to bear a distinct relationship to FIG. 1 in that in FIG. 6 we have indicated the positions of the elongate, vertically disposed apertures corresponding to apertures 32, 34, 36, 38 and 40, with aperture 36 being disposed in the central location, on the centerline of the component. However, to simplify the explanation of this aspect of our invention, instead of utilizing the reference numerals from FIG. 1, we prefer to identify the vertically disposed apertures in FIG. 6 as X, 1, 2, 3 and Y, with elongate aperture 2 corresponding to the central aperture 36 identified in FIG. 1.

As will be seen hereinafter, we typically do not pour concrete in apertures X and Y when pouring on 24" centers, but rather we typically pour in apertures 1 and 3.

With regard to the dimensions revealed in FIG. 6, it will be noted from this figure that we have defined a line W—W on the left hand side of the depicted component, with dimensions associated with the component being measured from line W—W.

We prefer for the end member 16*a* to be of 2" width, with the far edge of the vertically disposed aperture X extending for 7½" from the line W—W in FIG. 6. Because of this width of the end member 16*a*, the effective width of the vertical aperture X will he seen to be 5½". Although we are not to be limited, we typically prefer for all of apertures X, 1, 2, 3 and Y to be of a width of 5½", and of a height on the order of 24½". As previously mentioned, the resulting columns of concrete are some four times as high as they are wide.

Continuing with FIG. 6, it will be seen that we have utilized the letters A through L to indicate typical dimensions that we may utilize in connection with an exemplary embodiment of our lightweight panel when such panel is of the preferred length, which of course is 48". It is to be emphasized, however, that these are exemplary dimensions, and we are not to be limited thereto.

| | | | |
|---|---|---|---|
| A | 2" | G | 26 3/4" |
| B | 7 1/2" | H | 33 1/4" |
| C | 9 1/4" | I | 38 3/4" |
| D | 14 3/4" | J | 40 1/2" |
| E | 21 1/4" | K | 46" |
| F | 24" | L | 48" |

Inasmuch as when pouring concrete on 24" centers, we typically pour in generally vertically disposed apertures 1 and 3, it is to be understood that the centerpoint of aperture 1 is 12" from line W—W, the centerpoint of aperture 2 is 24" from line W—W, and the centerpoint of aperture 3 is 36" from the line W—W.

Although we are not to be limited to pouring concrete into the generally vertically disposed apertures on 24" centers utilizing apertures 1 and 3, we have found that this arrangement is satisfactory in a large number of instances. It is to be understood that when concrete is being poured on 24" centers, holes or apertures X and Y become of lesser importance.

In order to join several four foot STYROFOAM panels or components in an end-to-end relationship, we have found it is necessary to cut 21½" off of one end of the first panel, which is designated Panel 1 in FIG. 7. This means the construction worker would take a hot wire or saw and cut the panel at the location adjacent the hole or aperture 2. The 21½" section of the panel or component would then be discarded, or it would perhaps be used elsewhere.

As depicted in FIG. 7, a second panel (Panel 2) is then brought up, with the end of Panel 2 being butted up against the end of Panel 1. This causes the center of aperture or hole 1 of Panel 2 to be located 24" away from the center of hole or aperture 38 of Panel 1, and 24" away from the center of hole 3 of Panel 2.

Similarly, in FIG. 7 we show a third panel, Panel 3, which is installed in a right angle relationship to Panel 1.

The side of aperture X in Panel 3 is cut away down to the floor of the horizontal trough-like recess, thus to enable the placement of a rebar, preferably of "L" shape to be placed in the corner. Concrete is to be poured at this location so as to form a firm bond between aperture X of Panel 3 and aperture 2 of Panel 1, this of course being consistent with the construction depicted in FIGS. 4 and 5.

Inasmuch as FIG. 7 does not purport to show the trough-like recesses, no rebars are shown extending between Panel 1 and Panel 2, but in the typical construction, rebars are placed in the trough-like recesses extending through these members, with the 2" end members 16*a* and 18*a* shown in FIG. 1 being broken away so that rebars may extend in a generally continuous fashion along the several components or panels residing in an end-to-end relationship.

It should now be clear that we have provided a novel lightweight panel lending itself to the rapid yet economical construction of walls, which can be rapidly constructed by the utilization of a series of panels of identical configuration. Each panel may for example be approximately three to four times as high as it is wide, with each panel of the series being equipped with elongate, generally vertically disposed apertures into which concrete may be poured. The consistency of the placement of the apertures in such panels enables two or more panels to be placed in a stacked relationship such that a series of aligned vertically disposed apertures are defined. By pouring molten concrete into these aligned apertures, a series of vertically disposed, elongate concrete columns of considerable strength are created. The panels may be approximately of the width of an ordinary concrete block wall, and by creating panels that are approximately 32 inches high, a wall eight feet in height can be created by placing three of these novel panels in a stacked array.

It is to be noted that although we prefer our lightweight panels to be approximately three to four times as high as they are wide, they do not need to be molded in one piece, which is to say that if manufacturing economies warrant, we can make our panels in two 16" sections. Then, after the vertically disposed apertures are carefully in alignment, the upper and lower panel sections can be glued or cemented together shortly after the time of manufacture, such that builders will receive panels that are 32" high. We have found that a water base contact cement or polyurethane spray or foam is typically a satisfactory way of securing the upper and lower panel sections together. One commercial product usable for this purpose is Foam-Lok, manufactured by Demand Products. A structural adhesive such as Liquid Nails is often satisfactory for securing upper and lower panel sections together.

Although we often utilize lightweight structural panels wherein the long sidewalls 26 and 28 are two inches thick, with certain lightweight constructional materials and with certain weight-bearing requirements, we have found that each of the long sidewalls can be one inch thick. When the sidewalls are two inches thick, the component or panel is typically 9½ inches wide, whereas it is to be noted that when the sidewalls are one inch thick, the component or panel is typically 7½ inches wide. It is thus to be seen that when a component or panel is 32 inches high, the height of the panel is approximately three to four times its width.

We claim:

1. A component of plastic foam-type structural material to be utilized with a plurality of like components in the construction of a loadbearing wall, said component being elongate and generally in the configuration of a rectangular solid, said component having a pair of elongate sidewalls extending the full length and height of said component, said component also having a pair of end walls extending the full width and height of said component, said end walls and sidewalls forming a bottom section and an upper section of said component, a substantially continuous trough-like recess of essentially uniform depth defined between said end walls and sidewalls of said upper section and extending for a high percentage of the length of said upper section, and a plurality of elongate, generally vertically disposed apertures residing in an essentially parallel relationship in said lower section and below said trough-like recess, with said elongate apertures extending through said bottom section to said upper section, an upper end of each of said elongate apertures being blocked from contact with said trough-like recess by a relatively minor thickness of the plastic foam-type structural material of which said component is constructed, said trough-like recess for receiving and containing molten concrete, with some of such concrete being able to flow into and fill only those elongate apertures above which the relatively minor thickness of plastic foam-type blocking material has been removed, whereby when substantially identical components are utilized in combination, with a second component placed atop a first component and with said apertures of said components placed in substantial alignment, elongate columns of concrete will be created when molten concrete is poured into the trough-like recess of the uppermost component, which columns will extend through unblocked apertures of both components.

2. The component as recited in claim 1 wherein the height of said component is approximately three to four times its width.

3. The component as recited in claim 1 comprising at least five elongate, generally vertically disposed apertures disposed in a symmetrical relationship to said end portions, with at least two of said elongate apertures being located on 12" centers.

4. The component as recited in claim 1 further comprising reinforcement bars within said elongate apertures, said reinforcement bars having a length sufficient for extending a component, thus serving to help bind like components together.

5. The component as recited in claim 1 in which said generally vertically disposed apertures are in a substantially perpendicular relationship with said trough-like recess.

6. A load-bearing wall created by the use of a plurality of components of plastic foam-type structural material of substantially identical construction, each of said components being elongate and generally in the configuration of a rectangular solid, with each component having a pair of elongate sidewalls extending the full length of said component, each component further having a pair of end portions, a bottom section, and an upper section, such elongate sidewalls being flat and being constituted by upper side portions and lower side portions, a trough-like recess defined between said upper side portions of each component, and a plurality of elongate, generally vertically disposed apertures residing in an essentially parallel relationship between said lower side portions of each of said components and below the respective trough-like recess, with said elongate apertures extending into contact with the respective bottom section, the upper end of each of said elongate apertures of each component being blocked from the respective trough-like recess by a relatively minor thickness of the plastic foam-type structural material of which the component is constructed, each of said trough-like recesses being adapted to receive and contain molten concrete, with some of such concrete being able to flow into and fill only those elongate apertures above which the relatively minor thickness of blockage plastic foam-type structural material has been removed, said components, because of their substantially identical construction, being readily placed in a stacked array, with one or more of such components being placable with their generally vertically disposed apertures residing in a vertically aligned relationship, thus enabling molten concrete poured into such aligned apertures to create elongate columns of cement extending through the entire array of the stacked components when the concrete dries and becomes hard.

7. The load-bearing wall as recited in claim 6 in which at least three of said components reside in a stacked array, with their elongate apertures residing in alignment such that molten concrete can be poured through the aligned apertures of all three components.

8. The load-bearing wall as recited in claim 6 further comprising reinforcement bars in said generally vertically disposed apertures, said reinforcement bars extending between vertically stacked components, thus serving to help bind said components together.

9. A method of creating a wall utilizing an elongate component of plastic foam-type structural material in the configuration of a rectangular solid, with said component having a pair of elongate sidewalls extending the length of said component, a plurality of elongate, generally vertically disposed apertures residing in an essentially parallel relationship between said elongate sidewalls, above which is a trough-like recess from which said apertures are separated by blockage material, said method comprising the steps of removing the blockage material from locations above certain selected ones of said generally vertically disposed apertures, and pouring molten concrete into said trough-like recess, thus enabling some of such concrete to flow into and fill the selected elongate apertures.

10. The method as recited in claim 9 further comprising the step of inserting reinforcement bars into said generally vertically disposed apertures before the concrete pouring step.

11. The method as recited in claim 9 further comprising the step of providing a plurality of said components, because of their substantially identical construction, placed in a stacked array, with their respective generally vertically disposed apertures residing in a vertically aligned relationship, and pouring molten concrete into such aligned apertures to create elongate columns of concrete extending through the entire array of the stacked components when the concrete dries and becomes hard.

12. A component of plastic foam-type structural material to be utilized with a plurality of like components in the construction of a sturdy wall, said component being elongate and generally in the configuration of a rectangular solid, said component having a pair of elongate sidewalls, a pair of end portions, a bottom section, and an upper section, a trough-like recess extending in a continuous manner along substantially the full length of said upper section between said elongate sidewalls, said trough-like recess having a rectangular configuration with its depth greater than its width and a plurality of elongate, generally vertically disposed apertures disposed in an essentially parallel relationship below said trough-like recess, said apertures extending into contact with said bottom section, an upper end of each of said apertures being directly below said trough-like recess, when in use said trough-like recess receiving and containing molten concrete, readily removable blocking means located in the upper portions of said apertures, so that upon removal of said blocking means from selected apertures, some of such molten concrete is able to flow down from the trough-like recess and into the selected apertures, wherein a plurality of said components of plastic foam-type structural material, because of their substantially identical construction, are readily placed in a stacked array, with two or more of such components being placeable with their generally vertically disposed apertures residing in a vertically aligned relationship, thus enabling molten concrete poured into the trough-like recess and into selected apertures of the uppermost component, blocking means having been removed, to then pour down through unblocked apertures of the lower components, thus to create elongate, generally vertically disposed columns of concrete extending through the entire array of the stacked components when the concrete dries and becomes hard.

13. The component as recited in claim 12 in which the trough-like recesses of said components, when at least two of said components have been placed in an end-to-end relationship, are able to receive elongate reinforcement bars spanning between at least two of said components, such that upon molten concrete being poured into the trough-like recesses, such components will be held tightly together in such end-to-end relationship when the concrete sets.

14. The component as recited in claim 12 in which at least two of said apertures are disposed on predimensioned centers, such that when like components have been placed in end-to-end relationships, a spaced series of columns of concrete can be created along the length of the wall structural by pouring the molten concrete into selected aligned apertures of the stacked components.

15. The component as recited in claim 12 in which the apertures of said component are placed symmetrically, and at least two of said apertures are disposed on 24" centers, whereas the midpoint of each component is located 24" from the ends of said component, such arrangement thereby causing the apertures located on 24" centers, when like components have been placed in an end-to-end relationship, to bring about the creation of an equally spaced series of columns of concrete along the length of the structure as a result of the pouring of molten concrete into unblocked aligned apertures.

* * * * *